US006012581A

United States Patent [19]

Galazzo

[11] Patent Number: 6,012,581

[45] Date of Patent: Jan. 11, 2000

[54] STACKING DISPLAY FOR MERCHANDISE

[76] Inventor: Orazio Ray Galazzo, 134 Albee Ave., Staten Island, N.Y. 10312

[21] Appl. No.: 09/252,757

[22] Filed: Feb. 19, 1999

[51] Int. Cl.[7] ..... B65D 21/00

[52] U.S. Cl. ..... 206/499; 206/386; 206/509; 206/511; 206/821; 229/104; 229/190; 229/915

[58] Field of Search ..... 229/104, 171, 229/173, 190, 915; 206/509, 511, 821, 386, 597, 499, 765

[56] References Cited

U.S. PATENT DOCUMENTS

| | | | |
|---|---|---|---|
| D. 379,716 | 6/1997 | Zipperle . | |
| D. 395,117 | 6/1998 | Persson . | |
| 1,947,055 | 2/1934 | Moorman | 206/511 |
| 2,134,130 | 10/1938 | Hughes | 206/765 |
| 2,409,460 | 10/1946 | Waters | 229/190 X |
| 2,620,117 | 12/1952 | Nemoede | 206/386 X |
| 2,824,682 | 2/1958 | Powell | 229/104 |
| 4,195,732 | 4/1980 | Bell . | |
| 4,282,999 | 8/1981 | Meen . | |
| 4,512,468 | 4/1985 | Stravitz . | |
| 4,638,941 | 1/1987 | Watson | 229/104 |
| 4,690,287 | 9/1987 | Fershko . | |
| 4,913,290 | 4/1990 | DeGroot | 206/597 |
| 5,145,060 | 9/1992 | Maye | 206/765 X |
| 5,251,753 | 10/1993 | Pigott . | |
| 5,547,081 | 8/1996 | Mullock . | |
| 5,641,061 | 6/1997 | De Muylder-Braun . | |

FOREIGN PATENT DOCUMENTS

| | | | |
|---|---|---|---|
| 0573404 | 12/1993 | European Pat. Off. | 229/915 |
| 519135 | 3/1955 | Italy | 206/821 |

*Primary Examiner*—Byron P. Gehman
*Attorney, Agent, or Firm*—Goldstein & Canino

[57] ABSTRACT

A stacking display for merchandise including a first main panel comprised of a side panel, an upper edge panel, a lower edge panel, an upper floor panel, and a lower floor panel. A second main panel is provided that is comprised of a side panel, an upper edge panel, a lower edge panel, an upper floor panel, and a lower floor panel. A first small panel is provided that is comprised of a side panel having a first side foldably secured to a second side of the side panel of the first main panel. The first small panel includes an upper edge panel, a lower edge panel, an upper floor panel, and a lower floor panel. A second small panel is provided that is comprised of a side panel having a first side foldably secured to a second side of the side panel of the second main panel and a second side foldably secured to a first side of the side panel of the first main panel. The second small panel includes an upper edge panel, a lower edge panel, an upper floor panel, and a lower floor panel.

6 Claims, 8 Drawing Sheets

STACKING DISPLAY FOR MERCHANDISE

BACKGROUND OF THE INVENTION

The present invention relates to a stacking display for merchandise and more particularly pertains to stacking a variety of items on a shipping pallet in sections one on top of the other.

Many packages are individually packaged for sale to the ultimate consumer. Such prepackaged products, however, are typically shipped to the point of sale retailer in bulk form. Of course it is quite important for the product manufacturer to devise a shipping container which ensures that the prepackaged product will not be damaged in transit. Once the product has reached the point of sale retailer, the product must be either be put on shelves or in floor display. Typically, these floor displays are bulky, and often cheap looking cardboard shelves, that look presentable when full, but once the product starts to be removed, tend to present an appearance that most retailers can live without.

The present invention attempts to provide a stackable display unit that will securely hold products while at the same time be aesthetically pleasing. It will accomplish this by providing a plurality of separable trays that will stack one on top of the other while at the same time securing product within their own tray while at the same time securing to product on the tray immediately below.

The use of display trays is known in the prior art. More specifically, display trays heretofore devised and utilized for the purpose of displaying items for sale are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,251,753 to Pigott discloses a combination shipping and display unit comprised of a pallet with vertically stacked trays. U.S. Pat. No. 5,547,081 to Mullock discloses a stacking system with various protrusions incorporated. U.S. Pat. No. 4,282,999 to Moen discloses an H-shaped fiber board divider for containers. U.S. Pat. No. 3,055,494 to Hepp discloses a shipping and display container to support a number of piles of stacked articles. U.S. Pat. No. 5,641,061 to Muylder-Braun discloses a tray with an upper and lower layer for supporting display objects. U.S. Pat. No. 4,512,468 to Stravitz discloses a cassette storage device that appears to show a T-shaped configuration. U.S. Pat. No. 4,690,287 to Fershko discloses a shelve system for display units. U.S. Pat. No. 4,95,732 to Bell discloses a spacing system for stacking a number of rolls of web material with indentures to support rolls both above and below the spacer. U.S. Pat. No. Des. 379,716 to Sipperle and U.S. Pat. No. Des. 395,117 to Persson disclose various ornamental designs for pallet trays.

While these devices fulfill their respective, particular objective and requirements, the aforementioned patents do not describe a stacking display for merchandise for stacking a variety of items on a shipping pallet in sections one on top of the other.

In this respect, the stacking display for merchandise according to the present invention substantially departs from the conventional concepts and designs of the prior art, and in doing so provides an apparatus primarily developed for the purpose of stacking a variety of items on a shipping pallet in sections one on top of the other.

Therefore, it can be appreciated that there exists a continuing need for new and improved stacking display for merchandise which can be used for stacking a variety of items on a shipping pallet in sections one on top of the other. In this regard, the present invention substantially fulfills this need.

SUMMARY OF THE INVENTION

In the view of the foregoing disadvantages inherent in the known types of display trays now present in the prior art, the present invention provides an improved stacking display for merchandise. As such, the general purpose of the present invention, which will be described subsequently in greater detail, is to provide a new and improved stacking display for merchandise and method which has all the advantages of the prior art and none of the disadvantages.

To attain this, the present invention essentially comprises a first main panel comprised of a side panel having a rectangular configuration. The first main panel includes an upper edge panel foldably coupled with an upper edge of the side panel thereof. The upper edge panel has a pair of recesses extending inwardly of an upper edge thereof and a recess extending inwardly of a first side thereof and a tab extending outwardly of a second side thereof. The first main panel includes a lower edge panel foldably coupled with a lower edge of the side panel thereof. The lower edge panel has a pair of recesses extending inwardly of an upper edge thereof and a recess extending inwardly of a first side thereof and a tab extending outwardly of a second side thereof. The first main panel includes an upper floor panel foldably secured to an upper edge of the upper edge panel. The first main panel includes a lower floor panel secured to a lower edge of the lower edge panel. A second main panel is provided and is comprised of a side panel having a rectangular configuration. The second main panel includes an upper edge panel foldably coupled with an upper edge of the side panel thereof. The upper edge panel has a recess extending inwardly of a first side thereof and a tab extending outwardly of a second side thereof. The second main panel includes a lower edge panel foldably coupled with a lower edge of the side panel thereof. The lower edge panel has a recess extending inwardly of a first side thereof and a tab extending outwardly of a second side thereof. The second main panel includes an upper floor panel foldably secured to an upper edge of the upper edge panel. An outer edge of the upper floor panel of the second main panel has a pair of tabs extending outwardly therefrom. The second main panel includes a lower floor panel secured to a lower edge of the lower edge panel. An outer edge of the lower floor panel of the second main panel has a pair of tabs extending outwardly therefrom. A first small panel is provided and is comprised of a side panel having a rectangular configuration. The side panel of the first small panel has a first side foldably secured to a second side of the side panel of the first main panel. The first small panel includes an upper edge panel foldably coupled with an upper edge of the side panel thereof. The upper edge panel has a recess extending inwardly of a first side thereof and a tab extending outwardly of a second side thereof. The first small panel includes a lower edge panel foldably coupled with a lower edge of the side panel thereof. The lower edge panel has a recess extending inwardly of a first side thereof and a tab extending outwardly of a second side thereof. The first small panel includes an upper floor panel foldably secured to an upper edge of the upper edge panel. The first small panel includes a lower floor panel secured to a lower edge of the lower edge panel. A second small panel is provided and is comprised of a side panel having a rectangular configuration. The side panel of the second small panel has a first side foldably secured to a second side of the side panel of the second main panel and a second side foldably secured to a first side of the first main panel. The second small panel includes an upper edge panel foldably coupled with an upper edge of the side panel thereof. The upper edge panel has a recess extending inwardly of a first side thereof and a tab extending outwardly of a second side thereof. The second small panel includes a lower edge panel foldably coupled with a lower edge of the side panel thereof. The lower edge panel has a recess extending inwardly of a first side thereof and a tab extending outwardly of a second side thereof. The second small panel includes an upper floor panel foldably secured to an upper edge of the upper edge panel. The second small panel includes a lower floor panel secured to a lower edge of the lower edge panel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stacking display for merchandise which has all the advantages of the prior art display trays and none of the disadvantages.

It is another object of the present invention to provide a new and improved stacking display for merchandise which may be easily and efficiently manufactured and marketed.

It is a further object of the present invention to provide a new and improved stacking display for merchandise which is of durable and reliable construction.

An even further object of the present invention is to provide a new and improved stacking display for merchandise which is susceptible of a low cost of manufacture with regard to both materials and labor, and which accordingly is then susceptible of low prices of sale to the consuming public, thereby making such a stacking display for merchandise economically available to the buying public.

Even still another object of the present invention is to provide a new and improved stacking display for merchandise for stacking a variety of items on a shipping pallet in sections one on top of the other.

Lastly, it is an object of the present invention to provide a new and improved stacking display for merchandise including a first main panel comprised of a side panel, an upper edge panel, a lower edge panel, an upper floor panel, and a lower floor panel. A second main panel is provided that is comprised of a side panel, an upper edge panel, a lower edge panel, an upper floor panel, and a lower floor panel. A first small panel is provided that is comprised of a side panel having a first side foldably secured to a second side of the side panel of the first main panel. The first small panel includes an upper edge panel, a lower edge panel, an upper floor panel, and a lower floor panel. A second small panel is provided that is comprised of a side panel having a side panel foldably secured to a second side of the side panel of the second main panel and a second side foldably secured to a first side of the side panel of the first main panel. The second small panel includes an upper edge panel, a lower edge panel, an upper floor panel, and a lower floor panel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
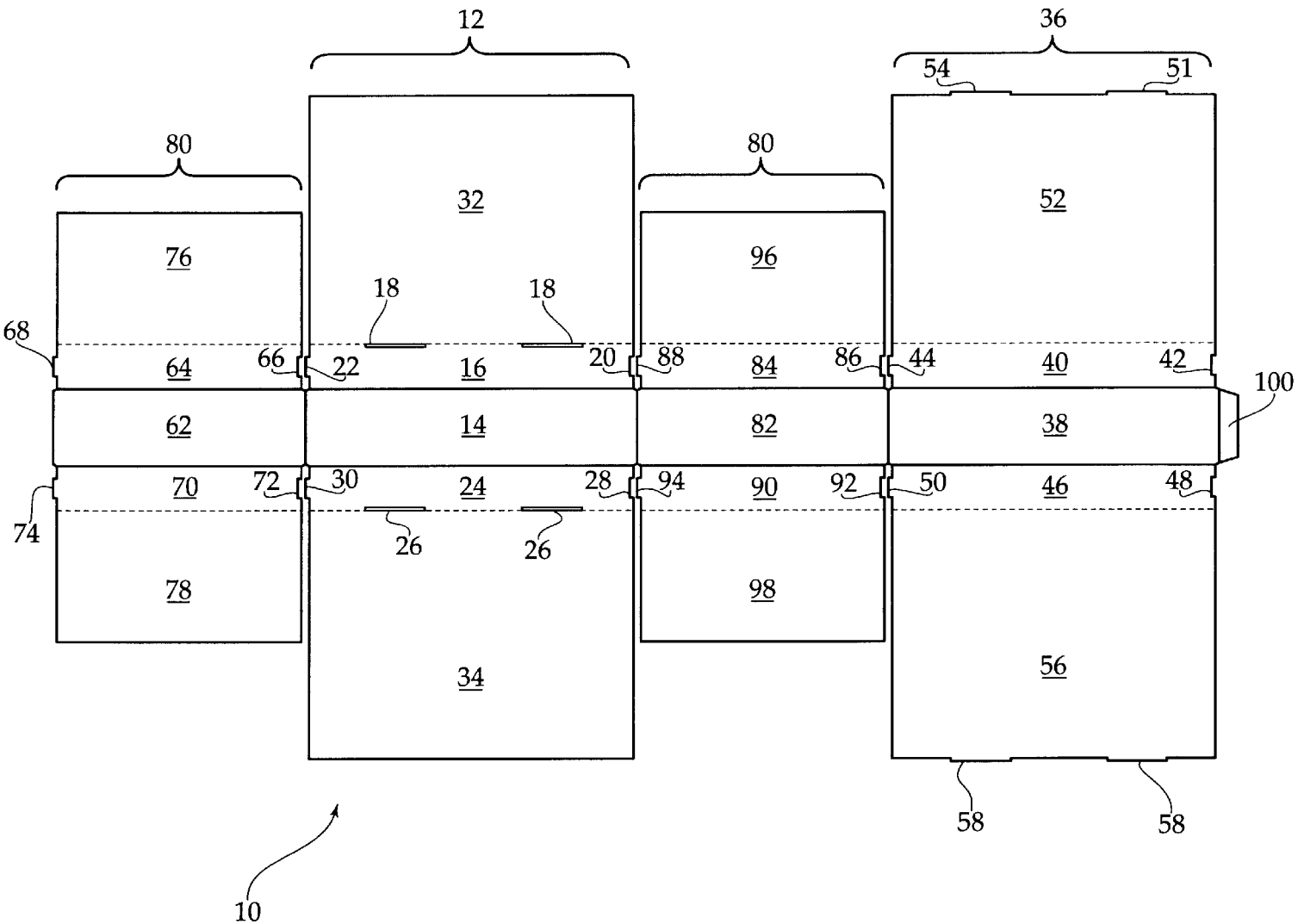
FIG. 1 is a plan view of the preferred embodiment of the stacking display for merchandise constructed in accordance with the principles of the present invention.

With reference now to the drawings, and in particular, to FIGS. 1 through 8 thereof, the preferred embodiment of the new and improved stacking display for merchandise embodying the principles and concepts of the present invention and generally designated by the reference number 10 will be described.

Specifically, it will be noted in the various Figures that the device relates to a stacking display for merchandise for stacking a variety of items on a shipping pallet in sections one on top of the other. In its broadest context, the device consists of a first main panel, a second main panel, a first small panel, and a second small panel. Such components are individually configured and correlated with respect to each other so as to attain the desired objective.

The first main panel 12 is comprised of a side panel 14 having a rectangular configuration. The first main panel 12 includes an upper edge panel 16 foldably coupled with an upper edge of the side panel 14 thereof. The upper edge panel 16 has a pair of recesses 18 extending inwardly of an upper edge thereof and a recess 20 extending inwardly of a first side thereof and a tab 22 extending outwardly of a second side thereof. The first main panel 12 includes a lower edge panel 24 foldably coupled with a lower edge of the side panel 14 thereof. The lower edge panel 24 has a pair of recesses 26 extending inwardly of an upper edge thereof and a recess 28 extending inwardly of a first side thereof and a tab 30 extending outwardly of a second side thereof. The first main panel 12 includes an upper floor panel 32 foldably secured to an upper edge of the upper edge panel 16. The first main panel 12 includes a lower floor panel 34 secured to a lower edge of the lower edge panel 24.

The second main panel 36 is comprised of a side panel 38 having a rectangular configuration. The second main panel 36 includes an upper edge panel 40 foldably coupled with an upper edge of the side panel 38 thereof. The upper edge panel 40 has a recess 42 extending inwardly of a first side thereof and a tab 44 extending outwardly of a second side thereof. The second main panel 36 includes a lower edge panel 46 foldably coupled with a lower edge of the side panel 38 thereof. The lower edge panel 46 has a recess 48 extending inwardly of a first side thereof and a tab 50 extending outwardly of a second side thereof. The second main panel 36 includes an upper floor panel 52 foldably secured to an upper edge of the upper edge panel 40. An outer edge of the upper floor panel 52 of the second main panel 36 has a pair of tabs 54 extending outwardly therefrom. The second main panel 36 includes a lower floor panel 56 secured to a lower edge of the lower edge panel 46. An outer edge of the lower floor panel 56 of the second main panel 36 has a pair of tabs 58 extending outwardly therefrom.

The first small panel 60 is comprised of a side panel 62 having a rectangular configuration. The side panel 62 of the first small panel 60 has a first side foldably secured to a second side of the side panel 14 of the first main panel 12. The first small panel 60 includes an upper edge panel 64 foldably coupled with an upper edge of the side panel 62 thereof. The upper edge panel 64 has a recess 66 extending inwardly of a first side thereof and a tab 68 extending outwardly of a second side thereof. The first small panel 60 includes a lower edge panel 70 foldably coupled with a lower edge of the side panel 62 thereof. The lower edge panel 70 has a recess 72 extending inwardly of a first side thereof and a tab 74 extending outwardly of a second side thereof. The first small panel 60 includes an upper floor panel 76 foldably secured to an upper edge of the upper edge panel 64. The first small panel 60 includes a lower floor panel 78 secured to a lower edge of the lower edge panel 70.

The second small panel 80 is comprised of a side panel 82 having a rectangular configuration. The side panel 82 of the second small panel 80 has a first side foldably secured to a second side of the side panel 38 of the second main panel 36 and a second side foldably secured to a first side of the side panel 14 of the first main panel 12. The second small panel 80 includes an upper edge panel 84 foldably coupled with an upper edge of the side panel 82 thereof. The upper edge panel 84 has a recess 86 extending inwardly of a first side thereof and a tab 88 extending outwardly of a second side thereof. The second small panel 80 includes a lower edge panel 90 foldably coupled with a lower edge of the side panel 82 thereof. The lower edge panel 90 has a recess 92 extending inwardly of a first side thereof and a tab 94 extending outwardly of a second side thereof. The second small panel 80 includes an upper floor panel 96 foldably secured to an upper edge of the upper edge panel 84. The second small panel 80 includes a lower floor panel 98 secured to a lower edge of the lower edge panel 90.

Figure 2:
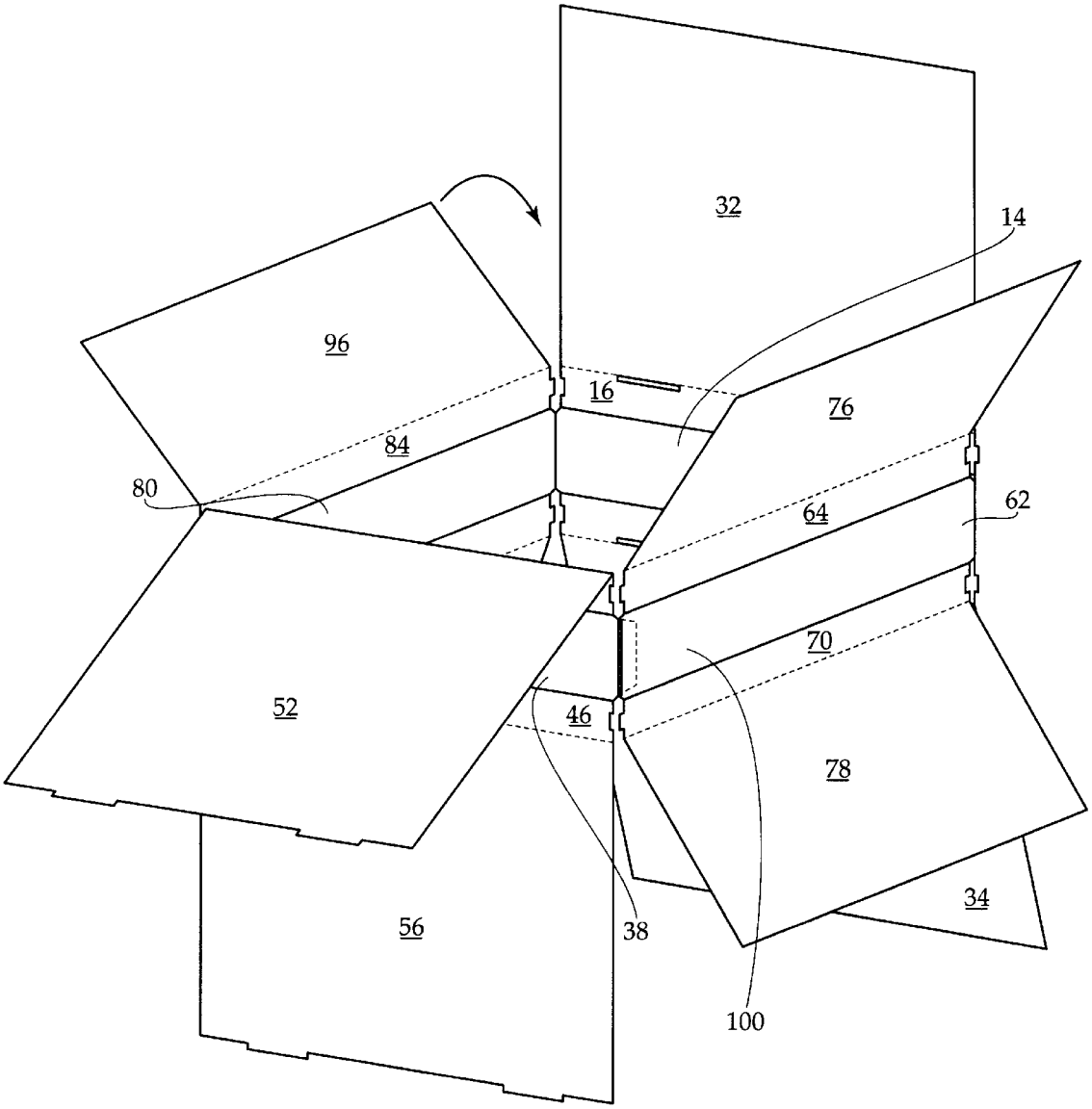
FIG. 2 is a perspective view of the present invention in a first orientation.
Figure 3:
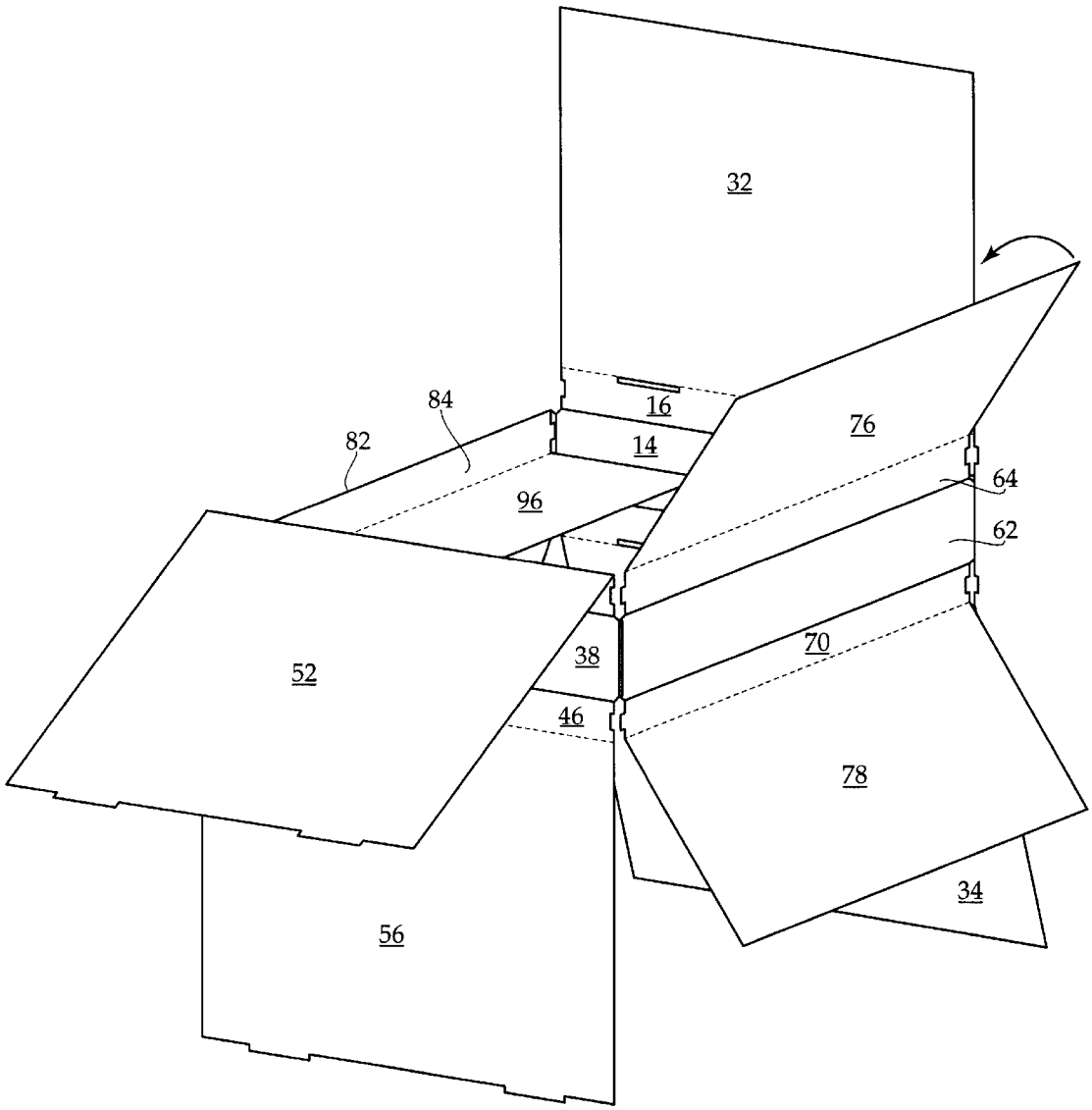
FIG. 3 is a perspective view of the present invention in a second orientation.
Figure 4:
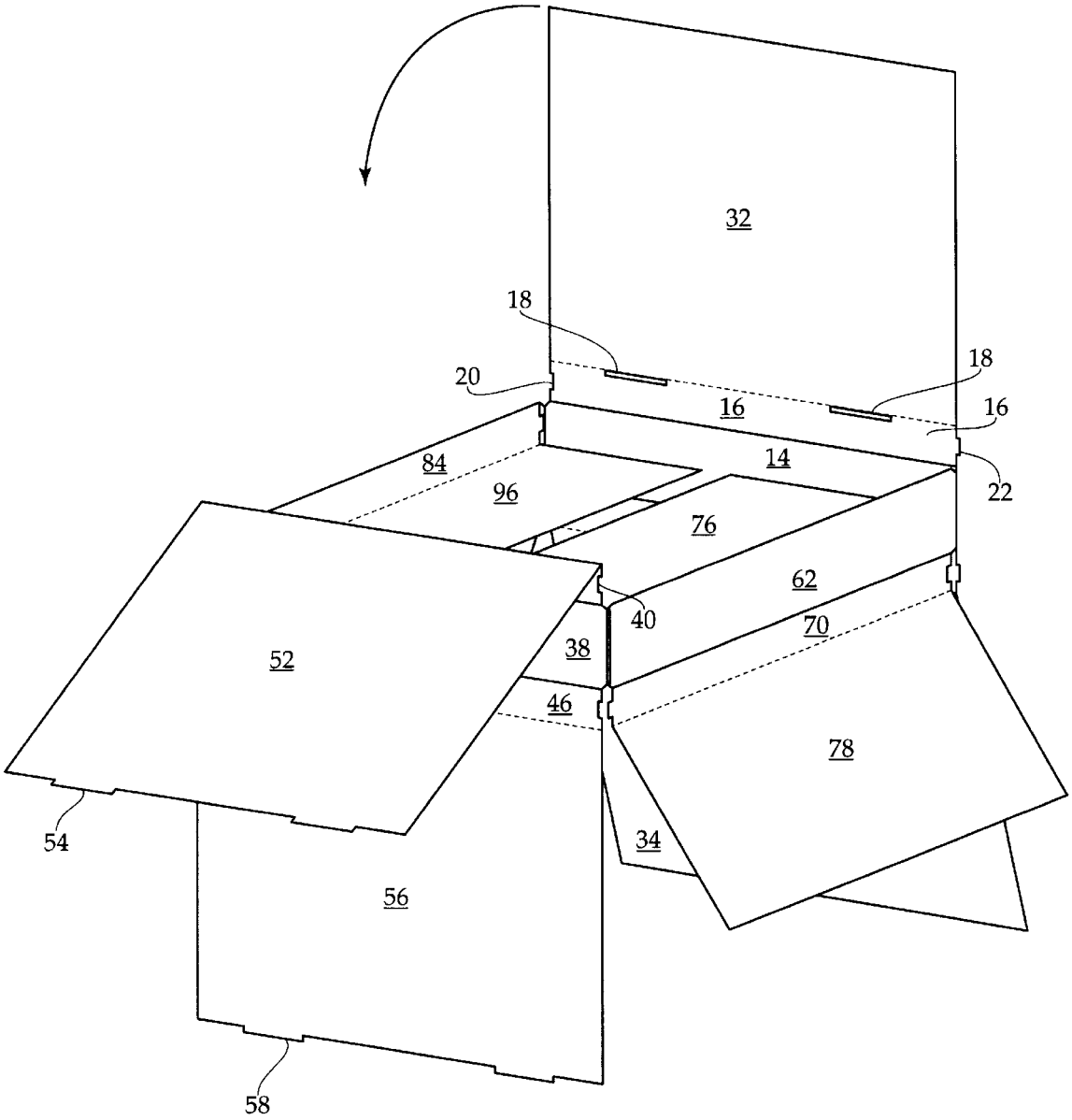
FIG. 4 is a perspective view of the present invention in a third orientation.
Figure 5:
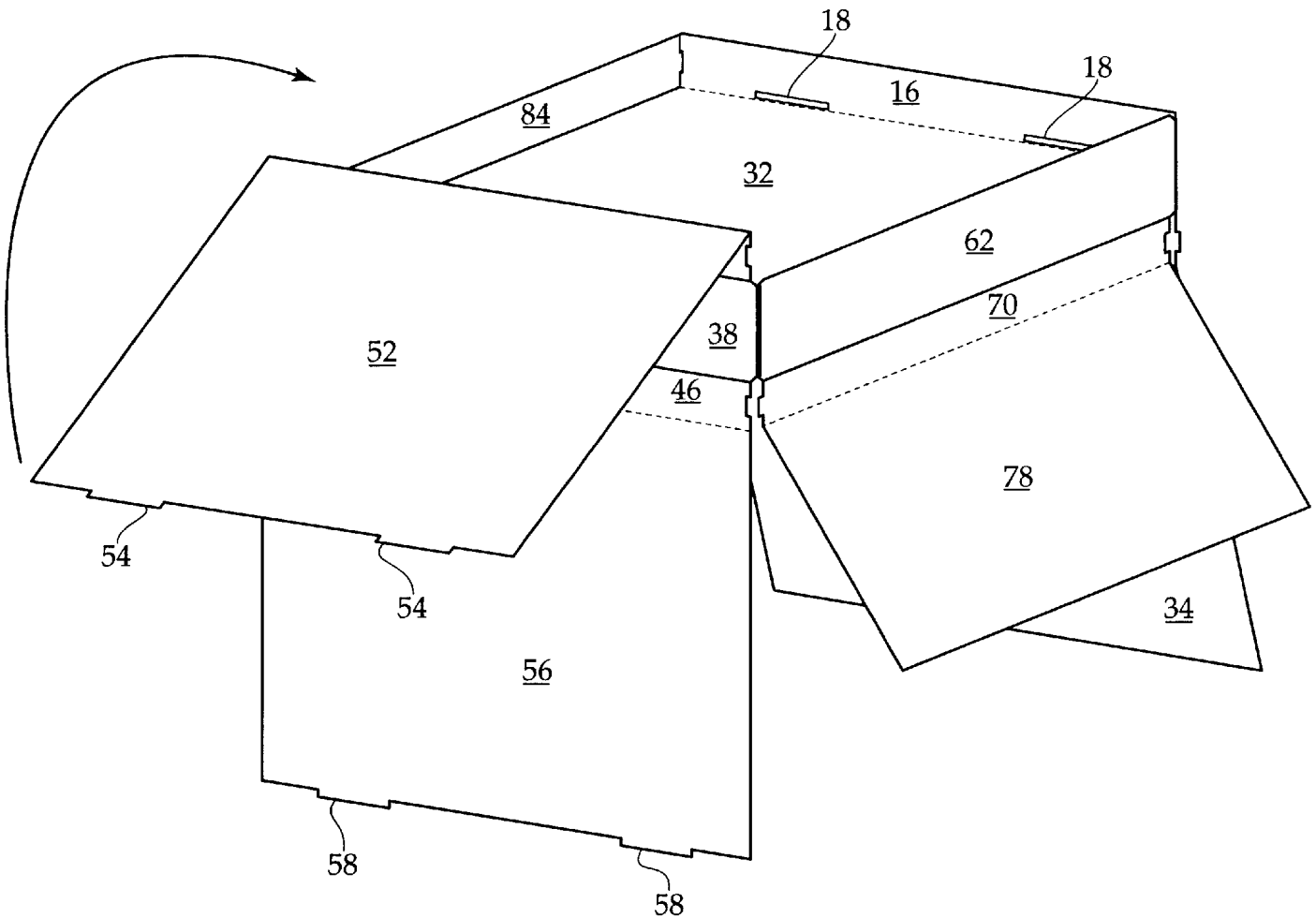
FIG. 5 is a perspective view of the present invention in a fourth orientation.

As the elements of the present invention has been described in detail, the next step is to illustrate how the display is constructed using all of the elements discussed above. The first step, as illustrated in FIG. 2, involves folding the side panels 14,38,62,82 together to form a rectangular frame. A locking tab 100 extending outwardly of a first side of the side panel 38 of second main panel 38 will be engaged to a second side of the side panel 62 of the first small panel 60, by either an adhesive or even by being inserted within a recess formed within the side panel 62 of the first small panel 60.

The next step, as illustrated in FIGS. 2 through 5 is to fold the upper floor panels 32,52,76,96 together to construct an upper support panel for holding product thereon. This step is accomplished by first folding the upper edge panels 64,84 down against their respective side panels 62,82 and then folding the respective upper floor panels 76,96 inwardly so that the upper floor panels 76,96 are essentially perpendicular to the side panels 62,82 and the upper edge panels 64,84. Note FIG. 4. The upper edge panels 16,40 of the first and second main panels 12,36 are then folded down against their respective side panels 14,38 with adjacent tabs and recesses of the upper edge panels 16,40,64,84 engaging one another. The upper floor panels 32,52 are then folded inwardly so that they are essentially perpendicular to the side panels 14,38 and are disposed immediately above the upper floor panels 76,96 of the small panels 60,80. The upper floor panel 52 of the second main panel 36 would be the last to be folded so that the tabs 54 thereof could be engaged with the recesses 18 of the upper edge panel 16 of the first main panel 12 so as to lock the upper support panel in place. Note FIG. 5.

Figure 6:
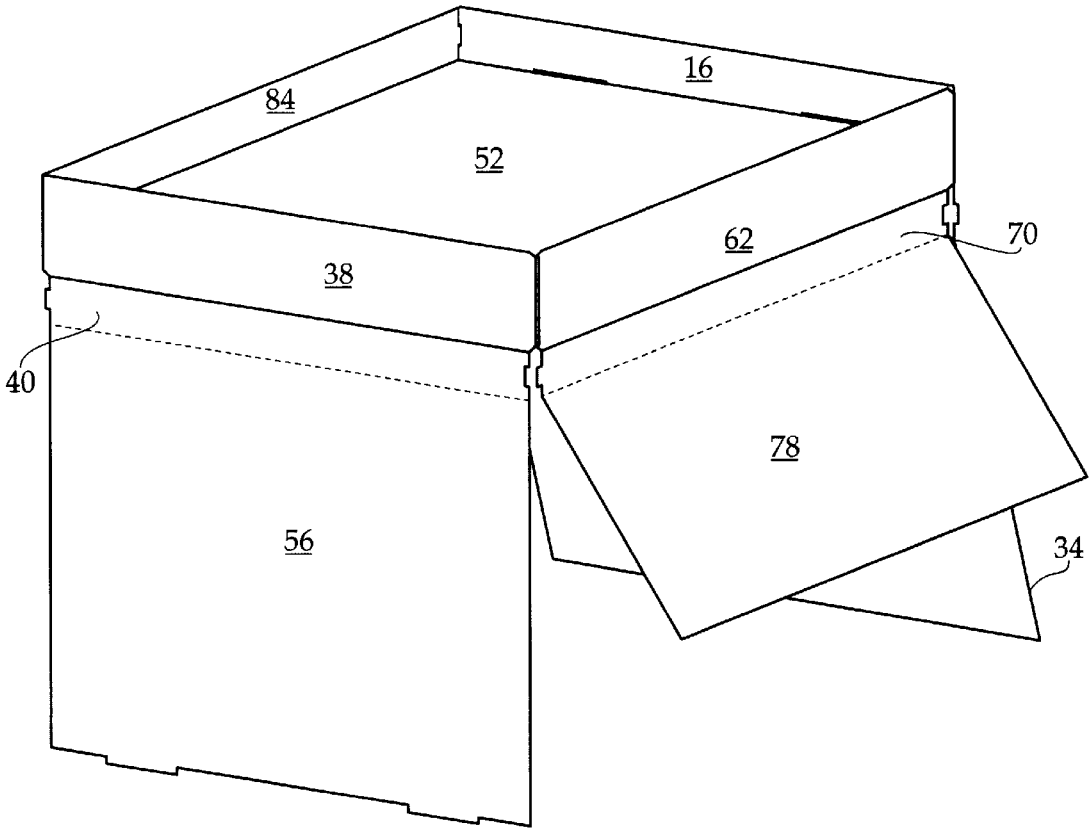
FIG. 6 is a perspective view of the present invention in a fifth orientation.

The next step, as illustrated in FIG. 6 is to fold the lower floor panels 34,56,78,98 together to construct a lower support panel for coupling with product disposed on a display 10 below. This step involves the similar folding and locking together of components discussed above using the lower edge panels 24,46,70,90 and lower floor panels 34,56,78,98 of the main panels 12,36 and the small panels 60,80. These steps are identical to the ones states above and will not be reiterated here.

Figure 8:
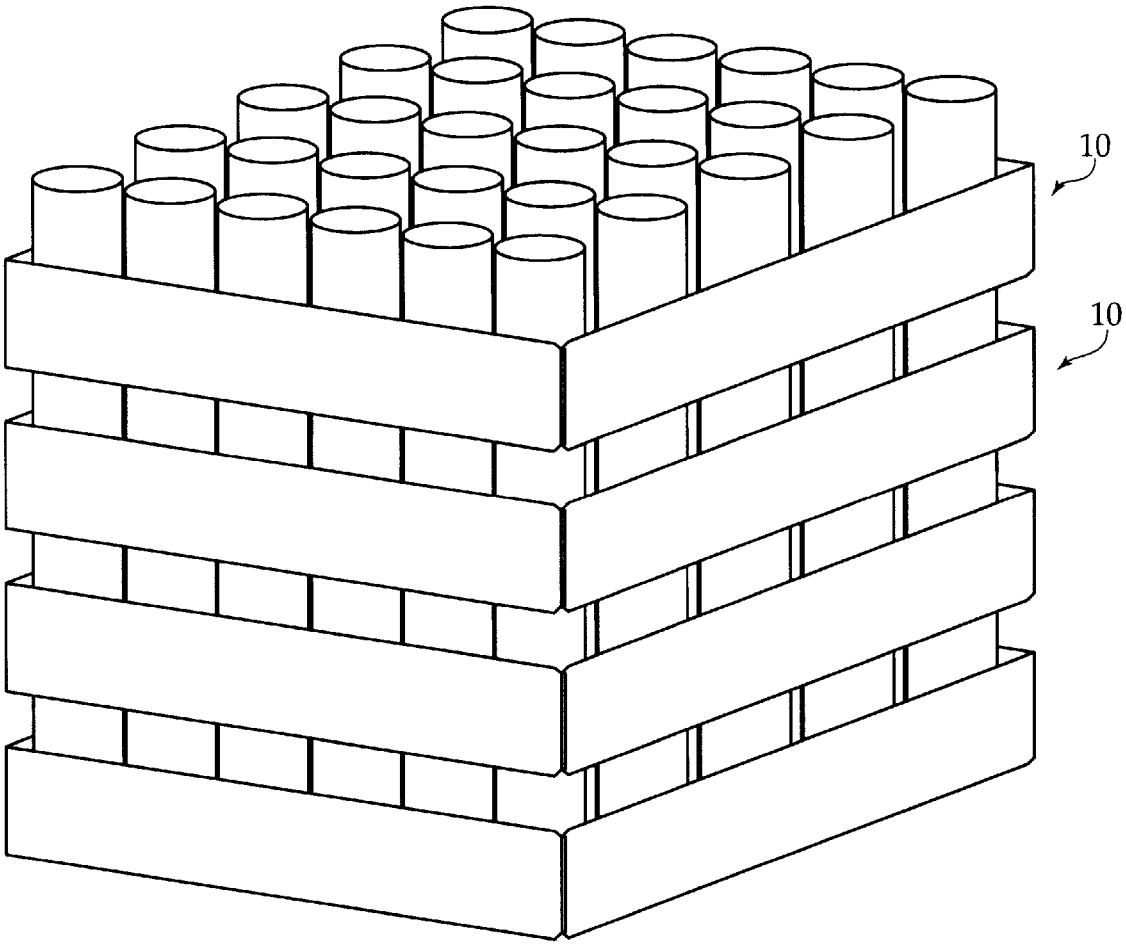
FIG. 8 is a perspective view of the present invention illustrated in a stacked orientation with merchandise disposed thereon.

Thus, the present invention will hold cans and the like, as illustrated in FIG. 8, whereby the displays 10 will be stacked on top of one another with one half of the display 10 holding the product on it's upper half while the lower half rests atop the cans on a display 10 positioned immediately below thereby creating a type of lock arrangement. Once a top display is empty, it is removed for customers to select from the next display.

Figure 7:
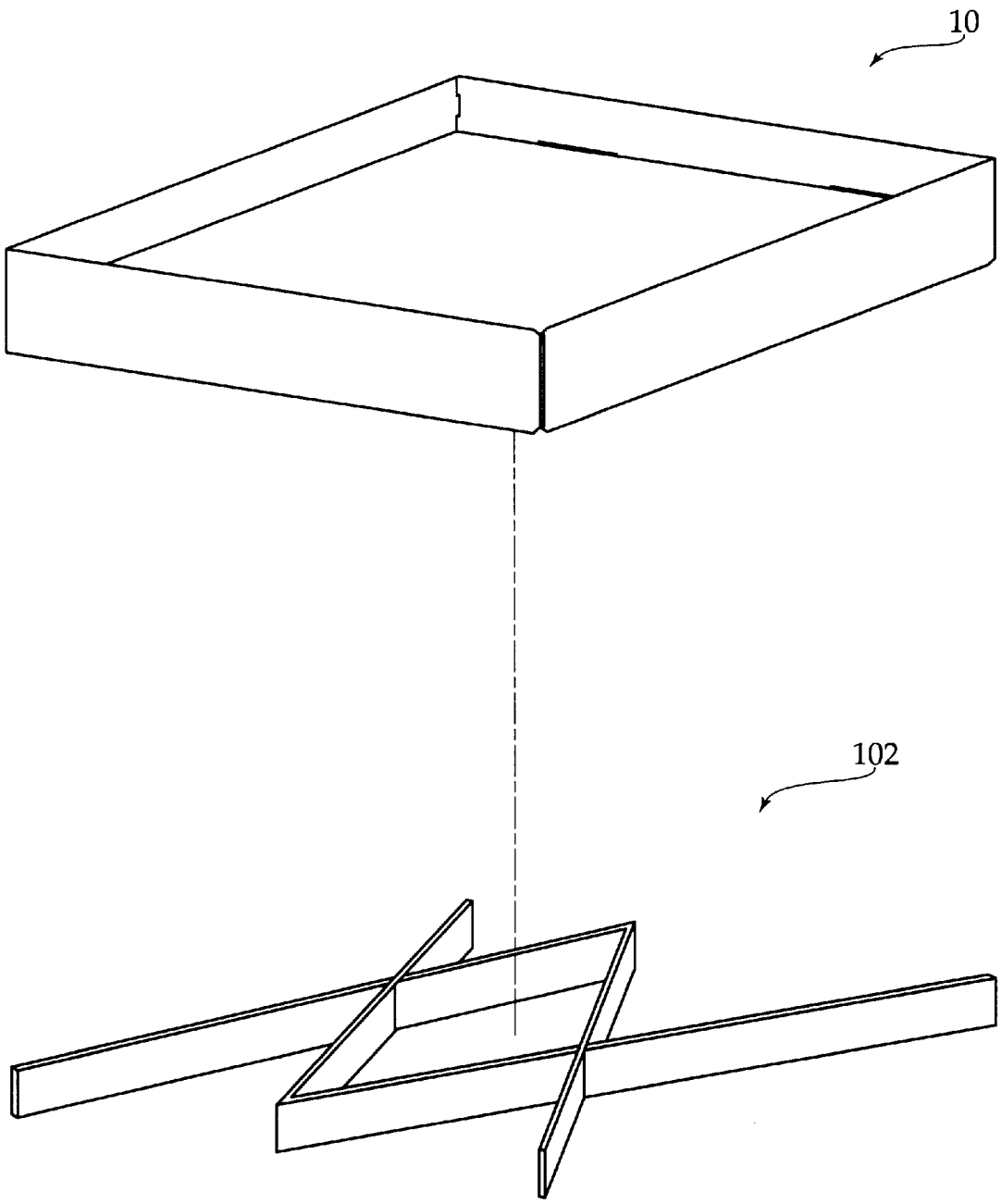
FIG. 7 is a perspective view of the present invention in a sixth and final orientation illustrated with a support matrix.

Although the cans do provide support for the display 10 positioned thereabove, the bottommost display 10 will not have the benefit of such an arrangement. FIG. 7 illustrates the use of a support matrix 102 that the bottommost display will rest upon so that the weight of the displays 10 positioned atop the bottommost display will not cause this particular display to collapse.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stacking display for merchandise for stacking a variety of items on a shipping pallet in sections one on top of the other comprising, in combination:

a first main panel comprised of a side panel having a rectangular configuration including first side and a second side, the first main panel including an upper edge panel foldably coupled with an upper edge of the side panel thereof, the upper edge panel having a pair of recesses extending inwardly of an upper edge thereof and a recess extending inwardly of a first side thereof and a tab extending outwardly of a second side thereof, the first main panel including a lower edge panel foldably coupled with a lower edge of the side panel thereof, the lower edge panel having a pair of recesses extending inwardly of an upper edge thereof and a recess extending inwardly of a first side thereof and a tab extending outwardly of a second side thereof, the first main panel including an upper floor panel foldably secured to an upper edge of the upper edge panel, the first main panel including a lower floor panel secured to a lower edge of the lower edge panel;

a second main panel comprised of a side panel having a rectangular configuration including first side and a second side, the second main panel including an upper edge panel foldably coupled with an upper edge of the side panel thereof, the upper edge panel having a recess extending inwardly of a first side thereof and a tab extending outwardly of a second side thereof, the second main panel including a lower edge panel foldably coupled with a lower edge of the side panel thereof, the lower edge panel having a recess extending inwardly of a first side thereof and a tab extending outwardly of a second side thereof, the second main panel including an upper floor panel foldably secured to an upper edge of the upper edge panel, an outer edge of the upper floor panel of the second main panel having a pair of tabs extending outwardly therefrom, the second main panel including a lower floor panel secured to a lower edge of the lower edge panel, an outer edge of the lower floor panel of the second main panel having a pair of tabs extending outwardly therefrom;

a first small panel comprised of a side panel having a rectangular configuration, the side panel of the first small panel having a first side foldably secured to the second side of the side panel of the first main panel, the first small panel including an upper edge panel foldably coupled with an upper edge of the side panel thereof, the upper edge panel having a recess extending inwardly of a first side thereof and a tab extending outwardly of a second side thereof, the first small panel including a lower edge panel foldably coupled with a lower edge of the side panel thereof, the lower edge panel having a recess extending inwardly of a first side thereof and a tab extending outwardly of a second side thereof, the first small panel including an upper floor panel foldably secured to an upper edge of the upper edge panel, the first small panel including a lower floor panel secured to a lower edge of the lower edge panel;

a second small panel comprised of a side panel having a rectangular configuration, the side panel of the second small panel having a first side foldably secured to the second side of the side panel of the second main panel and a second side foldably secured to a first side of the side panel of the first main panel, the second small panel including an upper edge panel foldably coupled with an upper edge of the side panel thereof, the upper edge panel having a recess extending inwardly of a first side thereof and a tab extending outwardly of a second side thereof, the second small panel including a lower edge panel foldably coupled with a lower edge of the side panel thereof, the lower edge panel having a recess extending inwardly of a first side thereof and a tab extending outwardly of a second side thereof, the second small panel including an upper floor panel foldably secured to an upper edge of the upper edge panel, the second small panel including a lower floor panel secured to a lower edge of the lower edge panel.

2. A stacking display for merchandise for stacking a variety of items on a shipping pallet in sections one on top of the other comprising, in combination:

a first main panel comprised of a side panel including first side and a second side, an upper edge panel, a lower edge panel, an upper floor panel, and a lower floor panel;

a second main panel comprised of a side panel including first side and a second side, an upper edge panel, a lower edge panel, an upper floor panel, and a lower floor panel;

a first small panel comprised of a side panel having a first side foldably secured to the second side of the side panel of the first main panel, the first small panel including an upper edge panel, a lower edge panel, an upper floor panel, and a lower floor panel;

a second small panel comprised of a side panel having a first side foldably secured to the second side of the side panel of the second main panel and a second side foldably secured to a first side of the side panel of the first main panel, the second small panel including an upper edge panel, a lower edge panel, an upper floor panel, and a lower floor panel.

3. The stacking display for merchandise as set forth in claim 2 wherein the first main panel includes the upper edge panel foldably coupled with an upper edge of the side panel thereof, the upper edge panel having a pair of recesses extending inwardly of an upper edge thereof and a recess extending inwardly of a first side thereof and a tab extending outwardly of a second side thereof, the lower edge panel foldably coupled with a lower edge of the side panel thereof, the lower edge panel having a pair of recesses extending inwardly of an upper edge thereof and a recess extending inwardly of a first side thereof and a tab extending outwardly of a second side thereof, the upper floor panel foldably secured to an upper edge of the upper edge panel, the lower floor panel secured to a lower edge of the lower edge panel.

4. The stacking display for merchandise as set forth in claim 2 wherein the second main panel includes the upper edge panel foldably coupled with an upper edge of the side panel thereof, the upper edge panel having a recess extending inwardly of a first side thereof and a tab extending outwardly of a second side thereof, the lower edge panel foldably coupled with a lower edge of the side panel thereof, the lower edge panel having a recess extending inwardly of a first side thereof and a tab extending outwardly of a second side thereof, the upper floor panel foldably secured to an upper edge of the upper edge panel, an outer edge of the upper floor panel of the second main panel having a pair of tabs extending outwardly therefrom, the lower floor panel secured to a lower edge of the lower edge panel, an outer edge of the lower floor panel of the second main panel having a pair of tabs extending outwardly therefrom.

5. The stacking display for merchandise as set forth in claim 2 wherein the first small panel includes the upper edge panel foldably coupled with an upper edge of the side panel thereof, the upper edge panel having a recess extending inwardly of a first side thereof and a tab extending outwardly of a second side thereof, the lower edge panel foldably coupled with a lower edge of the side panel thereof, the lower edge panel having a recess extending inwardly of a first side thereof and a tab extending outwardly of a second side thereof, the upper floor panel foldably secured to an upper edge of the upper edge panel, the lower floor panel secured to a lower edge of the lower edge panel.

6. The stacking display for merchandise as set forth in claim 2 wherein the second small panel includes the upper edge panel foldably coupled with an upper edge of the side panel thereof, the upper edge panel having a recess extending inwardly of a first side thereof and a tab extending outwardly of a second side thereof, the lower edge panel foldably coupled with a lower edge of the side panel thereof, the lower edge panel having a recess extending inwardly of a first side thereof and a tab extending outwardly of a second side thereof, the upper floor panel foldably secured to an upper edge of the upper edge panel, the lower floor panel secured to a lower edge of the lower edge panel.

* * * * *